United States Patent [19]

Morimoto et al.

[11] Patent Number: 5,001,994

[45] Date of Patent: Mar. 26, 1991

[54] METHOD OF CONTROLLING GENERATION OF CLINKER ASH FROM EXHAUST GAS DUST OF COAL

[75] Inventors: Iwao Morimoto; Hiroshi Sasaki, both of Hiroshima, Japan

[73] Assignee: Toa Trading Co., Ltd., Tokyo, Japan

[21] Appl. No.: 86,315

[22] Filed: Aug. 17, 1987

[30] Foreign Application Priority Data

Aug. 15, 1986 [JP] Japan ..... 61-191513

[51] Int. Cl.[5] ..... F23B 7/00

[52] U.S. Cl. ..... 110/342; 110/347; 110/345; 122/4 D; 44/603

[58] Field of Search ..... 44/603, 604, 607; 110/235, 238, 345, 342, 347; 122/4 D

[56] References Cited

U.S. PATENT DOCUMENTS

| | | | |
|---|---|---|---|
| 2,014,686 | 9/1935 | Lubovitch et al. | 44/603 |
| 2,016,821 | 10/1935 | Nelms | 44/603 |
| 2,364,828 | 12/1944 | Swartzman | 44/603 X |
| 3,332,755 | 7/1967 | Kukin . | |
| 3,348,932 | 10/1967 | Kukin | 44/603 X |
| 3,823,676 | 7/1974 | Cook . | |

FOREIGN PATENT DOCUMENTS

| | | |
|---|---|---|
| 2142342A | 1/1985 | Fed. Rep. of Germany . |
| 48-72202 | 9/1973 | Japan . |
| 55-144095 | 11/1980 | Japan . |
| 56-64204 | 6/1981 | Japan . |
| 60-501669 | 10/1985 | Japan . |

*Primary Examiner*—Henry A. Bennet
*Assistant Examiner*—Christopher B. Kilner
*Attorney, Agent, or Firm*—Wenderoth, Lind & Ponack

[57] ABSTRACT

The generation of clinker ash from exhaust gas dust in a boiler, furnace or the like which employs dust coal as a fuel can be controlled with excellent results by adding to a fuel at least one iron compound in a relatively small amount, and, preferably, at least one compound of a metal selected from the group consisting of Cu, Mn, Co, Ni and Cr, and, preferably, at least one compound of a metal selected from the group consisting of an alkali metal and an alkaline earth metal, in the form of an aqueous solution or a water slurry in which the particles are capable of passing through a 100-mesh screen.

8 Claims, 3 Drawing Sheets

ADHESION STATE OF CLINKER BY SIGNALS FROM FLAME DETECTOR

METHOD OF CONTROLLING GENERATION OF CLINKER ASH FROM EXHAUST GAS DUST OF COAL

BACKGROUND OF THE INVENTION

1. Field of the Invention

This invention relates to a method of controlling the generation of clinker ash from exhaust gas dust in a boiler, furnace or the like which employs dust coal as a fuel.

2. Description of the Prior Art

The use of boilers, furnaces, and the like which employ coal as a fuel has been increasing in recent years. However, because coal contains a small amount of volatile matter (20 to 30%) and an extremely high amount of fixed carbon (40 to 60%) as compared with heavy oil, it is less combustible. Therefore, recent types of coal-fired boilers and furnaces are designed to allow coal to be pulverized to less than 200 mesh (about 95%) in order to increase its activity and contact area with oxygen, thereby resulting in improved combustibility. Coal of low combustibility is fired in a blend with coal of greater combustibility.

Because coal has a much higher ash content (10 to 30%) than that of heavy oil, a great amount of ash is generated. For example, about 60,000 tons of ash per year is produced in a coal fired boiler of 500 T/H class. Coal ash is classified broadly into fly ash and clinker ash. Clinker ash is the ash which accumulates at a boiler bottom and comprises about 15% of the total ash quantity. The remainder is fly ash, which is collected in an air heater hopper and an electrostatic precipitator hopper. This ash contains mainly $SiO_2$ and $Al_2O_3$, with 15 to 20% or less of unburnt matter. The amount of ash produced may be roughly calculated from the ash content of a coal, but the properties of the ash generated vary with the type of coal.

A coal containing a large quantity of iron sulfide, because of its low melting point and high specific gravity, cannot be carried on a stream of gas and collides against furnace heating surfaces, resulting in accumulation of molten ash. This is referred to as slugging.

In the case of a coal containing a large quantity of alkali metal, because the compounds of alkali metal such as Na, K, etc. contained in the coal are activated due to reduction by carbon, carbon monoxide or hydrogen to react with $SiO_2$ present on a heating surface and thus to produce low-melting alkali silicates (for example, $Na_2SiO_3$), ash in the coal adheres to the resulting tacky water-glass-like substance, resulting in enlargement of the ash. This is referred to as fouling.

A combination of these conditions causes both slugging and fouling and results in enlargement of the ash in the form of a large clinder-like agglomerate formed on the burner throat or heating surface. FIG. 1 shows the positions in which these adverse effects take place. When these effects occur, the following problems result:

(1) the gas temperature of a furnace outlet may increase due to reduced absorption of heat by the furnace;

(2) enlargement of the ash due to adhesion of a molten slug to a burner throat may cause blockage, resulting in burning problems in extreme cases;

(3) a large agglomerate which has accumulated in a furnace may drop in the form of clinker, resulting in damage being caused to a waterwall tube;

(4) rise in temperature of an exhaust gas as mentioned in (1) above and rise in temperature of the metals of which a superheater and a reheater are made may lead to an increased amount vapor spray, resulting in reduced boiler efficiency;

(5) temperature difference between waterwall tubes increases due to adhesion of slug; and (6) an increase in the generation of clinker ash leads to its reduced flowability which in turn causes blockage and results in certain problems with respect to disposal of the furnace bottom ash.

To prevent the occurrence of these problems, measures are taken to reduce loads or to change the type of coal employed. In an extreme case, operations may be stopped, and cleaning of the inside of a furnace, disposal of the clinker, and cleaning of the pipes has to be undertaken. Such a situation leads to serious financial loss.

In general, the ash which has dropped and accumulated at the bottom of a furnace is referred to as clinker ash but in the present specification this term also includes slug (ash) which has adhered to boiler heating surfaces.

Methods of removing molten clinker ash include the following:

(1) blowing ash off with vapor from a sootblower;

(2) reducing the temperature of a furnace, or reducing the temperature of a tube wall;

(3) reducing the load;

(4) changing the type of coal employed; and (5) absorbing any molten alkali metal present on a heating surface by means of an alkali metal-collecting additive, such as $SiO_2$ powder or organic $SiO_2$.

However, these methods have the following disadvantages.

Whilst the above means (1) is effective, it is difficult to install sootblowers over the entire inside area of a furnace both from the physical and the economical viewpoints. Furthermore, because molten clinker is an adherent, it is difficult to remove slugging even when utilizing increased pressure. Excessive pressure or applying pressure with excessive frequency may cause a heating surface to suffer erosion and to be reduced in wall thickness, resulting in the bursting of a heating surface.

The above means (2) and (3) undesirably involve the reconstruction of a boiler or a reduction in efficiency.

The above means (4) has a certain advantage in that selection of a type of coal which is, for example, $$\frac{Fe_2O_3 + CaO + MgO + Na_2O + K_2O}{SiO_2 + Al_2O_3 + TiO_2} < 0.4$$

provides reduced slugging, but is not entirely satisfactory.

In the case of the above means (5), powder injection of high-melting $SiO_2$ and $Al_2O_3$ inversely promotes slugging, bringing about an elevated exhaust gas temperature and increased melting. Although addition of $SiO_2$ type additives has been performed with the aim of physically adsorbing any alkali metal substance on a heating surface, this measure does not represent a fundamental solution. Furthermore, these additives have no effect on $FeS_2$ slugging. At present there are no effective additives available which aim at controlling clinker. Although iron oxide powder has in the past been charged directly from a burner into a boiler or a furnace for the purpose of reducing soot and dust, adhesion of particles to the heating surface in such cases was found to inversely promote slugging, resulting in an increased exhaust gas temperature. Thus, there has to date been no effective means for controlling the clinker ash produced by the burning of dust coal.

SUMMARY OF THE INVENTION

It is therefore an object of the present invention to provide a method of controlling, with excellent effect, clinker ash generated by exhaust gas dust which would otherwise cause various problems described above in a boiler, a furnace, or the like employing dust coal as a fuel.

Other objects and advantages of the present invention will become apparent to those skilled in the art from the following description and disclosure.

DETAILED DESCRIPTION OF THE PREFERRED EMBODIMENT

Figure 1:
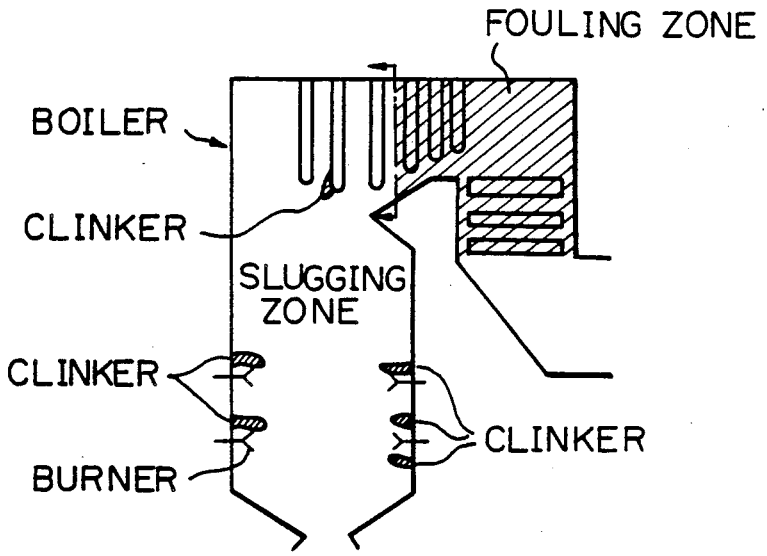
FIG. 1 is a schematic drawing which shows the points at which slugging, fouling, and clinker originate.

By adding at least one iron compound in a relatively small amount, and, preferably, at least one compound of a metal selected from the group consisting of Cu, Mn, Co, Ni and Cr, and, preferably, at least one compound of an alkali metal selected from the group consisting of Na, K, Li, etc., or compounds of an alkaline earth metal selected from the group consisting of Ba, Ca, Mg, etc. in the form of an aqueous solution or a water slurry in which metal compound particles capable of passing through a 100-mesh screen or an iron compound powder capable of passing through a 200-mesh screen are contained, the following effects can be obtained in the burning of dust coal containing a significant amount of alkali metals or iron sulfides:

(1) Ferrous sulfide FeS produced by oxidation of ferric sulfide $FeS_2$ present in coal reacts with the additive to give magnetite $Fe_3O_4$ and to increase the melting point (1371° C.) and to reduce degree of adherence of the slug, resulting in a dry ash.

In a reducing condition, reduction to $Fe_3O_4$ of the $Fe_2O_3$ that adheres to coal particles gives a dry porous slug which has a tendency to fall off even in the state of adhesion, resulting in a reduced amount of adhesion.

(2) Because the iron strongly adhering to a surface controls the activation that is caused by the reduction of alkali metal compounds present in coal by carbon or CO (catalytic action), production of low-melting alkali silicates is prevented, resulting in a dry porous non-adhering slug.

The present invention provides a method of controlling the generation of clinker ash which exhibits the excellent results described above even in a reducing condition which is unfavorable in comparison with an oxidizing condition because the clinker has a lower melting point in the former condition than it does in the latter.

Suitable iron compounds include water-soluble iron salts, such as ferrous acetate, ferrous sulfate, ferric sulfate, ferric acetate, iron chloride, iron hydroxide, etc., or $Fe_2O_3$, $Fe_3O_4$, FeO, FeOOH, $Fe(OH)_3$, etc. Water slurries of these compounds are also effective, provided that their particles are small enough to pass through a 100-mesh screen, and the smaller the size of particles, the smaller the amount of water slurry that needs to be added.

For the oxidation-promoting function of iron, compounds of Cu, Mn, Co, Ni and Cr that may be exemplified include CuO, $CuSO_4$, $CuCl_2$, MnO, $MnSO_4$, $CoSO_4$, $NiSO_4$, $MnCl_2$, CoO, $CoCl_2$, $NiCl_2$, $Na_2Cr_2O_7$, $Cr_2O_3$, $CrO_3$, $K_2Cr_2O_7$, $Cr(OH)_3$, $CrCl_2$, $CrCl_3$, $CrCl_4$, $Cr_2(SO_4)_3$, etc. As auxiliaries for promoting the oxidation-catalyzing function of iron, compounds of alkali metals consisting of Na, K, Li, etc. that may be mentioned include NaCl, $Na_2SO_4$, $Na_2CO_3$, $NaNO_3$, NaOH, KCl, $K_2SO_4$, $KCO_3$, $KNO_3$, KOH, LiCl, $Li_2SO_4$, $LiCO_3$, $LiNO_3$, LiOH, etc., while suitable compounds of alkaline earth metals consisting of Ba, Ca, Mg include BaO, $BaSO_4$, $BaCl_2$, $BaCO_3$, $BaNO_3$, $Ba(OH)_2$, CaO, $CaSO_4$, $Ca(OH)_2$, $CaCl_2$, $CaCO_3$, $Ca(NO_3)_2$, $Ca(OH)_2$, MgO, $MgSO_4$, $MgCl_2$, $MgCO_3$, $Mg(NO_3)_2$, $Mg(OH)_2$, etc.

Iron compounds are preferably in the range of 2 to 200 ppm (in terms of $Fe_2O_3$) on the basis of the amount of dust coal. Less than 2 ppm of iron compounds gives an undesirable effect. More than 200 ppm of iron compounds shows no improvement in the required effect and merely reduces the economic efficiency.

Each of at least one compound of a metal selected from the group consisting of Cu, Mn, Co and Ni, and/or at least one compound of an alkali metal selected from the group consisting of Na, K, Li, etc., or one compound of an alkaline earth metal selected from the group consisting of Ba, Ca, Mg, etc. is preferably provided in an amount within the range of 50 ppm or less (in terms of their respective oxides) on the basis of the amount of dust coal. More than 50 ppm shows no improvement in the required effect and would be uneconomic.

The present invention will be explained below referring to the flow sheet of FIG. 2.

Figure 2:
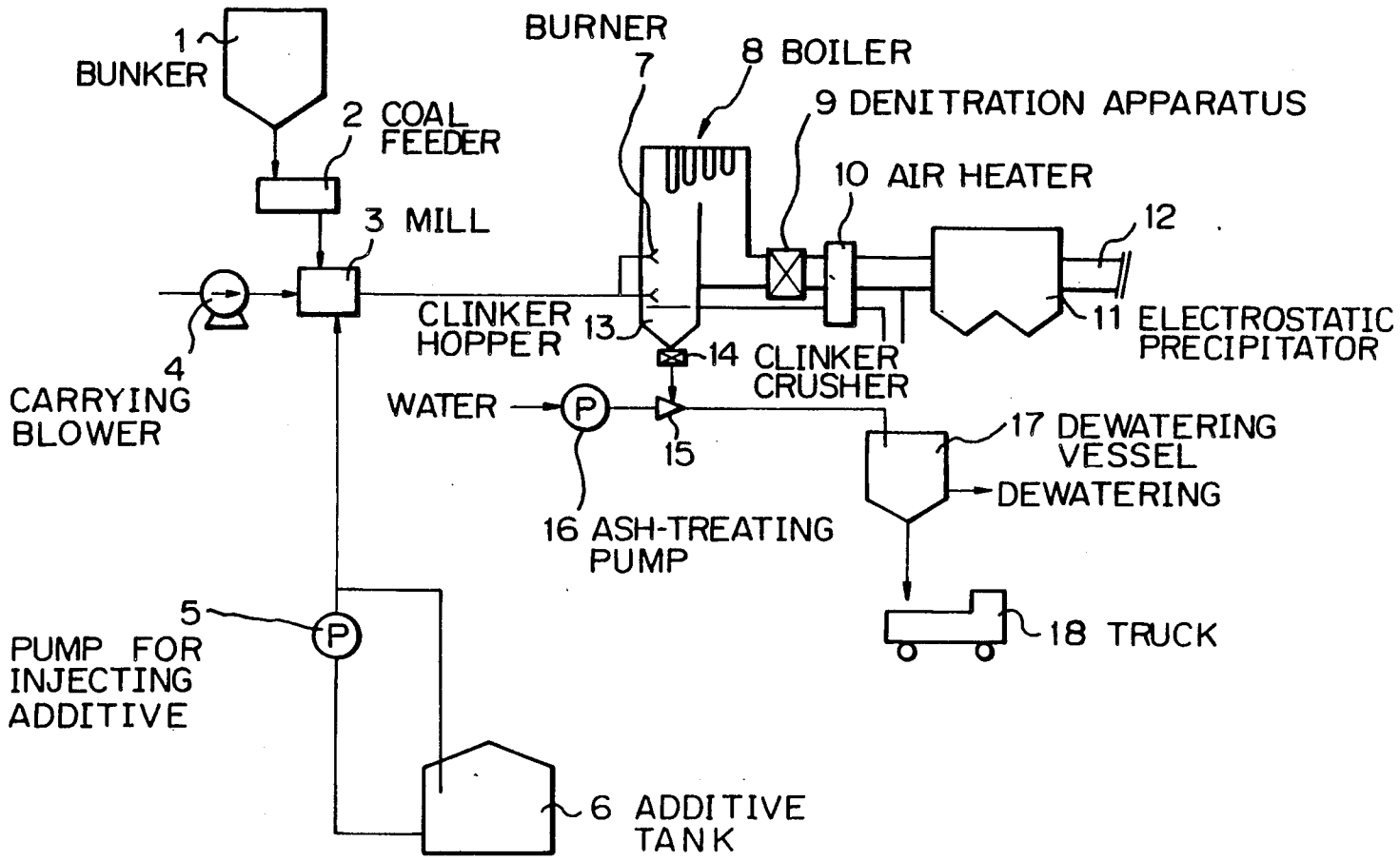
FIG. 2 is a flow sheet used in the practice of the present invention.

In FIG. 2, 1 denotes a bunker which temporarily stores coal, 2 is a coal feeder which weighs the coal delivered from the bunker and feeds a fixed amount of coal, 3 is a mill which pulverizes coal to a size of 200 mesh. 4 is a blower which carries the pulverized coal by air to a burner 7. 6 is a tank for containing an additive of the present invention. 5 is a pump for injecting the additive and is a constant delivery pump which is capable of feeding a fixed amount of additive to a fuel. The injection point is located at an inlet of the mill, where the additive is blended with the pulverized coal. The mill inlet is most suitable point for the injection because the additive adheres to the surfaces of coal particles and is then strongly pressed down on these surfaces by a roller of the mill. When there are a plurality of mills, an additive is added at a point upstream of each mill. 9 is a denitration apparatus, 10 is an air heater, 11 is an electrostatic precipitator, and 12 is a flue through which exhaust gas dust is released to a funnel. 13 is a clinker hopper which collects clinker ash that falls from heating surfaces.

Clinker is crushed by a clinker crusher 14, and is delivered together with water through an ejector 15 to a dewatering vessel 17 by means of an ash-treating pump 16. Dewatered clinker is loaded onto trucks 18 and then buried as a waste material.

Dust coal is fed from a burner to a boiler 8 for burning. In burning, the action of the iron compounds present can be considered as follows:

When the temperature reaches about 600° C., the added compound gasifies carbon by the reaction of $Fe_2O_3+C \rightarrow 2FeO+Co$, and is reduced to FeO. This FeO, being highly reactive, reacts with atomic oxygen to be oxidized into $Fe_2O_3$.

$$2FeO+\tfrac{1}{2}O_2 \rightarrow Fe_2O_3$$

$$C+\tfrac{1}{2}O_2 \rightarrow CO$$

As may be seen from these reaction formulae, the iron compound adheres to the surface of dust coal and gasifies carbon while functioning as a catalyst. On the other hand, because the iron compound (oxidized into $Fe_2O_3$) reacts readily with a reducing substance at an elevated temperature of 600° C., any $Na_2O$ and $K_2O$ present in the dust coal are subjected to reduction, so that the production of gaseous reactive alkali metals is controlled. That is, FeO produced in a reducing atmosphere reacts with atomic oxygen to promote burning, whereby the reactions of $$Na+\tfrac{1}{2}O_2 \rightarrow Na_2O \text{ (mist) and}$$

$$K_2+\tfrac{1}{2}O_2 \rightarrow K_2O \text{ (mist)}$$

are controlled. Thus, because the release of reactive alkali metal vapor of $Na_2O$ is controlled, the reactions of $$Na_2O+SiO_2 \rightarrow Na_2SiO_3 \text{ and}$$

$$K_2O+SiO_2 \rightarrow K_2SiO_3$$

are controlled, resulting in a higher melting point and a reduced amount of clinker. These iron compounds usually have a particle size capable of passing through a 100-mesh screen, and preferably 1μ or less. The smaller the particle size, the higher their reactivity and the smaller the amount of additive required. The iron contents of coal is mainly present in inorganic form such as $FeS_2$, $FeCO_3$, $Fe_2O_3$, etc. In particular, $FeS_2$ is oxidized into FeS ($FeS_2+O_2 \rightarrow FeS+SO_2$). Although the FeS is present in a liquid form because of its low melting point of 1179° C., adhesion of an iron compound of the surface of the FeS causes the following reaction:

$$FeS+Fe_2O_3+3/2\,O_2 \rightarrow Fe_3O_4+SO_2.$$

The high melting point of $Fe_3O_4$ results in a porous slug.

The iron adhering to the surface converts to $Fe_3O_4$ which has a reduced degree of adherence in a reducing atmosphere, and consequently the $Fe_3O_4$ readily falls.

If no iron compound is added, FeS is oxidized to give a low-melting point substance.

$$2FeS+3O_2 \rightarrow 2FeO+2SO_2$$

$$FeO+SiO_2 \rightarrow FeSiO_3 \text{ (melting point: 1147° C.)}$$

As an example, portions of fuel consisting of 2, 40 and 200 ppm of an aqueous solution of ferrous acetate were dropped onto coal before charging it into a mill, the coal being of the composition shown in Table 1. A boiler was operated at a load of 180 MW without addition of iron, and at an increased load of 190 MW with addition of iron, the amount of slugging and fouling and the amount of clinker produced being compared. The amount of $O_2$ at the outlet of an economizer (ECO) was about 3.5% in each case. The results are shown in Table 2. The amount of slugging and fouling which occurred decreased to a large extent as the amount of ferrous acetate solution added was increased. Addition of 2 ppm, 40 ppm and 200 ppm, respectively reduced the amount of slugging and fouling to ½, ⅓ and 1/5 in comparison with the case where none was added. Addition of more than 200 ppm did not result in any increased reduction below the amount achieved with addition of 200 ppm.

Although in the case where no iron compound was added a great amount of clinker adhered to the burner throat as if flowers were out, addition of only 2 ppm of an iron compound led to almost no adhesion of clinker. Increasing the load of a boiler usually results in an increased furnace temperature and an increased amount of slugging and clinker. The addition of an iron compound showed the effect of reducing the amount of slugging and clinker. Table 3 shows the results obtained by adding an aqueous solution of ferrous sulfate in the amounts of 2, 40 and 200 ppm in the same boiler. The same results as in the case of ferrous acetate solution were obtained. Table 4 shows the results obtained by adding $Fe_2O_3$ powder having an average particle diameter of 70μ to the coal before charging it into the mill under the same operating conditions as in the case of Table 3. Even addition of 200 ppm only achieved a 50% decrease in the amount of slugging compared with the case where none was added, this result being inferior to the ⅓ achieved in the case of ferrous sulfate. Also, the gas temperature of the ECO outlet increased by about 10° C. On addition of 1500 ppm, the exhaust gas temperature increased by 60° C., and the amount of slugging and clinker was equivalent to the level achieved in the case where none was added. If the $Fe_2O_3$ has a much larger particle diameter than that of ferrous sulfate a reduced effect is obtained and the resulting excessive adhesion adversely increases the exhaust gas temperature.

TABLE 1

| Analysis of coal ash for test | |
|---|---|
| $SiO_2$ | 46.9% |
| $Al_2O_3$ | 22.8% |
| $Fe_2O_3$ | 5.5% |
| CaO | 7.4% |
| MgO | 2.5% |
| $Na_2O$ | 1.3% |
| $K_2O$ | 0.9% |
| Melting point | 1350° C. |
| Ash content | 13.5% |
| Volatile matter | 44.7% |
| Fixed carbon | 36.5% |
| Fuel ratio | 0.8% |

TABLE 2

| Reduction of amount of clinker ash in a pulverized coal fired boiler | | | | | | |
|---|---|---|---|---|---|---|
| | | No addition of iron | Addition of aqueous solution of ferrous acetate | | | |
| Load | MW | 180 | 190 | 190 | 190 | 190 |
| Amount of coal | T/H | 73 | 75 | 75 | 76 | 76 |
| Amount of iron added (ppm) (in terms of $Fe_2O_3$) | | — | 2 | 40 | 200 | 500 |

TABLE 2-continued

| | | Reduction of amount of clinker ash in a pulverized coal fired boiler | | | | |
|---|---|---|---|---|---|---|
| | | No addition of iron | Addition of aqueous solution of ferrous acetate | | | |
| ECO outlet $O_2$ | % | 3.5 | 3.5 | 3.5 | 3.4 | 3.4 |
| Amount of slugging and fouling | | 1 | ½ | ⅓ | 1/5 | 1/5 |
| Amount of clinker | | much around burner | little | little | little | little |
| Compositional analysis of clinker | | | | | | |
| $SiO_2$ | % | 54.98 | — | 54.54 | — | — |
| $Al_2O_3$ | % | 26.22 | — | 26.03 | — | — |
| $Fe_2O_3$ | % | 5.48 | — | 4.68 | — | — |
| MgO + CaO | % | 9.98 | — | 11.00 | — | — |
| $Na_2O + K_2O$ | % | 1.89 | — | 2.00 | — | — |
| $SO_3$ | % | <0.05 | — | <0.05 | — | — |
| Unburnt carbon | | <0.1 | — | <0.1 | — | — |
| Melting point | °C. | 1350 | — | 1360 | — | — |
| ECO outlet temperature | °C. | 350 | — | 350 | — | 36.5 |

Note: The amount of slugging and fouling is shown as the ratio of the absolute amount to the amount in the case where no iron was added.

TABLE 3

| | | No addition of iron | Aqueous solution of ferrous sulfate | | |
|---|---|---|---|---|---|
| Load | MW | 175 | 175 | 175 | 175 |
| Amount of coal | T/H | 70 | 70 | 70 | 70 |
| Iron (in terms of $Fe_2O_3$) | ppm | — | 2 | 40 | 200 |
| ECO outlet $O_2$ | % | 4.0 | 4.1 | 4.1 | 4.1 |
| Amount of slugging | | 1 | ½ | ⅓ | 1/5 |
| Amount of clinker | | much around burner | little | little | little |

TABLE 4

| | | Aqueous solution of ferrous sulfate | Powder of $Fe_2O_3$ | | |
|---|---|---|---|---|---|
| Average particle diameter | | 50Å | 70μ | | |
| Addition amount | ppm | 40 | 40 | 200 | 1500 |
| Amount of slugging | | ⅓ | ¾ | ½ | 1 |
| Amount of clinker | | little | little | little | much around a burner |
| ECO outlet temperature | °C. | 350 | 350 | 360 | 410 |
| Effect | | good | slightly good | good | increased temperature of an exhaust gas, melting |

Note: The amount of slugging is shown as the ratio of the absolute amount to the amount in the case where none was added.

Table 5 shows the results obtained by adding the mixture of aqueous solution of ferrous sulfate (2, 40, 200 ppm in terms of $Fe_2O_3$) and aqueous solution of copper sulfate (2 ppm in terms of CuO) at a point upstream of the mill. In relation to the amount of slugging, better results were obtained than in the case where ferrous sulfate solution alone was used. The amount of clinker generated was almost equivalent to the level in the case where ferrous sulfate solution alone was employed.

TABLE 5

| | | No addition of iron | Aqueous solution of ferrous sulfate + aqueous solution of copper sulfate | | |
|---|---|---|---|---|---|
| Load | MW | 180 | 180 | 180 | 180 |
| Amount of coal | T/H | 73 | 73 | 74 | 73 |
| Addition amount (ppm) of iron (in terms of $Fe_2O_3$) + copper (in terms of CuO) | | — | 2<br>2 | 40<br>2 | 200<br>2 |
| ECO outlet $O_2$ | % | 3.5 | 3.6 | 3.5 | 3.4 |
| Amount of slugging | | 1 | ½ | ¼ | 1/5 |
| Amount of clinker | | much around burner | little | little | little |
| Compositional analysis of clinker | | | | | |
| $SiO_2$ | % | 54.98 | — | 54.30 | — |
| $Al_2O_3$ | % | 26.22 | — | 26.01 | — |
| $Fe_2O_3$ | % | 5.48 | — | 4.73 | — |
| MgO + CaO | % | 9.98 | — | 11.34 | — |
| $Na_2O + K_2O$ | % | 1.89 | — | 2.01 | — |
| $SO_3$ | % | <0.05 | — | <0.05 | — |
| Unburnt carbon | % | <0.0 | — | <0.1 | — |
| Melting point | °C. | 1350 | — | 1370 | — |
| ECO outlet temperature | °C. | 350 | — | 350 | — |

Table 6 shows the results obtained by adding a mixture of an aqueous solution of ferrous sulfate and an aqueous solution of sodium carbonate (2 ppm in terms of $Na_2O$). Table 7 shows the results obtained by adding a mixture of an aqueous solution of ferrous acetate and an aqueous solution of sodium carbonate (2 ppm in terms of $Na_2O$). Both cases gave better results than in the case where ferrous sulfate solution alone was added.

TABLE 6

| | | No addition of iron | Aqueous solution of ferrous sulfate + aqueous solution of sodium carbonate | | |
|---|---|---|---|---|---|
| Load | MW | 180 | 180 | 180 | 180 |
| Amount of coal | T/H | 73 | 73 | 73 | 73 |
| Addition amount (ppm) of iron (in terms of $Fe_2O_3$) + sodium (in terms of $Na_2O$) | | — | 2<br>2 | 40<br>2 | 200<br>2 |
| ECO outlet $O_2$ | % | 3.5 | 3.5 | 3.5 | 3.7 |
| Amount of slugging | | 1 | ⅓ | ¼ | 1/5 |
| Amount of clinker | | much around burner | little | little | little |
| Compositional analysis of clinker | | | | | |
| $SiO_2$ | % | 54.98 | — | 54.32 | — |
| $Al_2O_3$ | % | 26.22 | — | 26.10 | — |
| $Fe_2O_3$ | % | 5.48 | — | 5.23 | — |
| MgO + CaO | % | 9.98 | — | 11.0 | — |
| $Na_2O + K_2O$ | % | 1.89 | — | 2.17 | — |
| $SO_3$ | % | <0.05 | — | <0.05 | — |
| Unburnt carbon | % | <0.1 | — | <0.1 | — |
| Melting point | °C. | 1350 | — | 1360 | — |
| ECO outlet temperature | °C. | 350 | — | 350 | — |

TABLE 7

| | | No addition of iron | Aqueous solution of ferrous acetate + aqueous solution of sodium carbonate | | |
|---|---|---|---|---|---|
| Load | MW | 175 | 175 | 175 | 175 |
| Amount of coal | T/H | 70.0 | 70.0 | 70.1 | 70.3 |
| Addition amount (ppm) of | | — | 2 | 40 | 200 |

TABLE 7-continued

| | | No addition of iron | Aqueous solution of ferrous acetate + aqueous solution of sodium carbonate | | |
|---|---|---|---|---|---|
| iron (in terms of $Fe_2O_3$) + sodium (in terms of $Na_3O$) | | | 2 | 2 | 2 |
| ECO outlet $O_2$ | % | 4.0 | 4.1 | 4.0 | 4.1 |
| Amount of slugging | | 1 | ½ | ¼ | 1/5 |
| Amount of clinker | | much around burner | little | little | little |

Table 8 shows the results obtained by adding a mixture of an aqueous solution of ferrous sulfate and 2 ppm of an aqueous solution of calcium carbonate to the coal at a point upstream of the mill. Better results than in the case where ferrous sulfate solution alone was added were obtained.

TABLE 8

| | | No addition of iron | Aqueous solution of ferrous sulfate + aqueous solution of calcium carbonate | | |
|---|---|---|---|---|---|
| Load | MW | 180 | 190 | 190 | 190 |
| Amount of coal | T/H | 73 | 75 | 76 | 76 |
| Addition amount (ppm) of iron (in terms of $Fe_2O_3$) + calcium (in terms of CaO) | | — | 2<br>2 | 40<br>2 | 200<br>2 |
| ECO outlet $O_2$ | % | 3.5 | 3.7 | 3.6 | 3.5 |
| Amount of slugging | | 1 | ½ | ¼ | 1/5 |
| Amount of clinker | | much around burner | little | little | little |
| Compositional analysis of clinker | | | | | |
| $SiO_2$ | % | 54.98 | — | 54.25 | — |
| $Al_2O_3$ | % | 26.22 | — | 26.13 | — |
| $Fe_2O_3$ | % | 5.48 | — | 4.61 | — |
| MgO + CaO | % | 9.98 | — | 11.16 | — |
| $Na_2O + K_2O$ | % | 1.89 | — | 2.33 | — |
| $SO_3$ | % | <0.05 | — | <0.1 | — |
| Unburnt carbon | % | <0.1 | — | <0.1 | — |
| Melting point | °C. | 1350 | — | 1370 | — |
| ECO outlet temperature | °C. | 350 | — | 351 | — |

Table 9 shows the results obtained by adding a mixture of an aqueous solution of ferrous sulfate, an aqueous solution of copper sulfate and an aqueous solution of calcium carbonate to the coal at a point upstream of the mill. Better results were obtained in comparison with the data of Table 5 in which example no calcium sulfate solution was added.

TABLE 9

| | | No addition of iron | Aqueous solution of ferrous sulfate + aqueous solution of copper sulfate + aqueous solution of calcium sulfate | | |
|---|---|---|---|---|---|
| Load | MW | 175 | 175 | 175 | 175 |
| Amount of coal | T/H | 70 | 71 | 70 | 70 |
| Addition amount (ppm) of iron (in terms of $Fe_2O_3$) + copper (in terms of $Cu_2O$) + calcium (in terms of CaO) | | — | 4<br>2<br>2 | 40<br>2<br>10 | 200<br>2<br>20 |
| ECO outlet $O_2$ | % | 4.1 | 4.1 | 4.2 | 4.0 |
| Amount of slugging | | 1 | ½ | ¼ | 1/6 |
| Amount of clinker | | much around burner | little | little | little |

TABLE 9-continued

| | | No addition of iron | Aqueous solution of ferrous sulfate + aqueous solution of copper sulfate + aqueous solution of calcium sulfate |
|---|---|---|---|
| | | burner | |

It is considered that Cu performs an auxiliary action as an oxidizing catalyst for the Fe, while Na and Ca perform auxiliary functions as agents for absorbing a sulfur component which would cause a reduction in the oxidizing catalytic ability of Fe. Thus, an aqueous solution of Fe is much more effective than a powder of Fe, and further addition of Cu, Na and/or Ca to the solution provides an improved effect.

Figure 4:
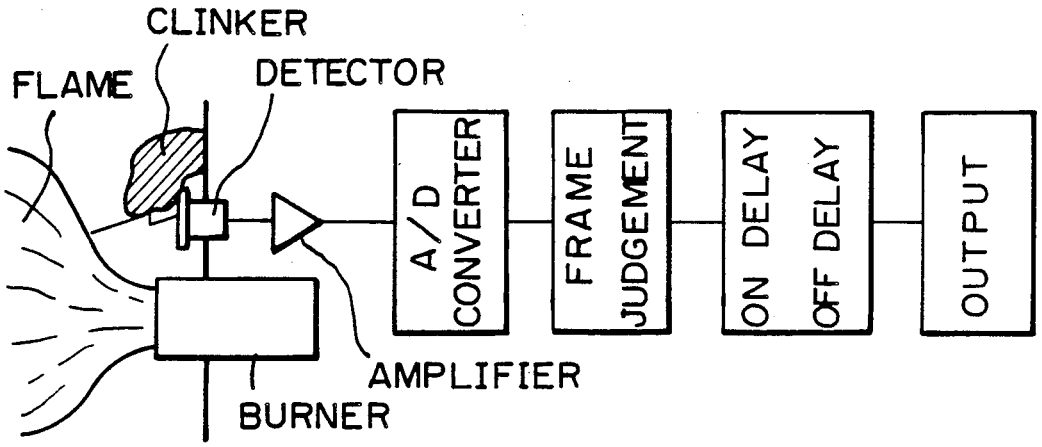
FIG. 4 is a schematic drawing of a detecting circuit for examining the adhesion of clinker around a burner.
Figure 3:
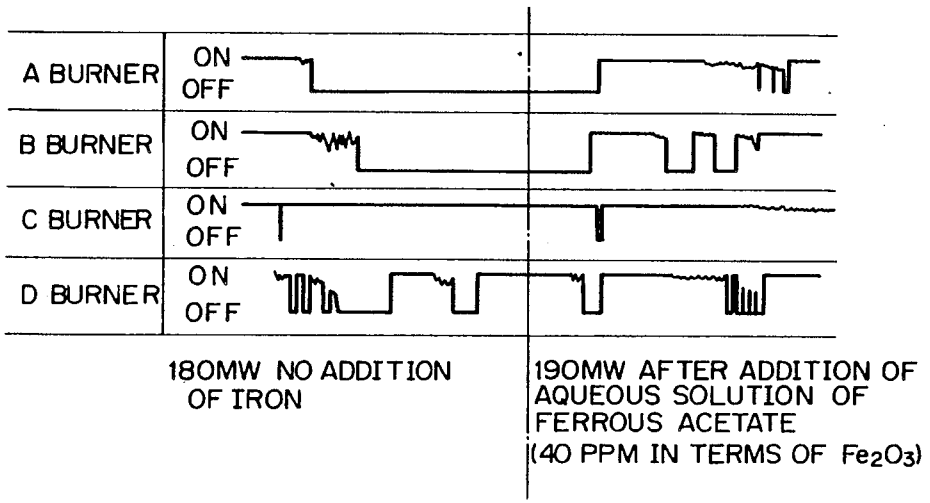
FIG. 3 is a drawing which shows the adhesion of clinker by signals from a flame detector.

The situation with respect to adhesion of clinker around the burner was examined by detecting infrared rays generated from a flame and then by plotting output signals from a flame detector that detected an accidental fire caused by the flame. The results are shown in FIG. 3. FIG. 4 is a detecting circuit diagram. Check was made on four burners A, B, C and D. Loads of 180 MW in the case of no addition and 190 MW in the case of addition of an aqueous solution of ferrous acetate were employed. If none is added, a relatively long period of OFF state results. In contrast, addition of iron allows the clinker which will adhere to the detecting part to be readily separated. This shows clearly that the amount of slugging and clinker is different from the case of no addition described above. These charts also show an improved slugging characteristic due to the addition of iron.

Table 10 shows the results obtained by, in the case of adding 40 ppm of ferrous acetate solution (in terms of $Fe_2O_3$), adding (1) 10 ppm to each mill A, B, C and D, (2) 20 ppm to the mills of A and B, and 0 ppm to the mills C and D, and (3) 40 ppm to the mill A, and 0 ppm to the mills B, C and D. Case (1) showed an almost equivalent level of $O_2$ at the ECO outlet (3.5 to 3.6%) for A and B ducts. Case (2) showed 3.2% for A duct and 4.3% for B duct. Case (3) showed 3.0% for A duct and 4.5% for B duct, leading to a more unbalanced amount of oxygen. This is because the iron which has obtained activity by the addition of an iron compound consumes oxygen which is present in different amounts at each point, leading to uneven diffusion of oxygen. As may be seen from the results, it is preferable that an equivalent amount of the solution is added to each of a plurality of mills.

TABLE 10

| | | | | |
|---|---|---|---|---|
| Additon amount of an aqueous solution of ferrous acetate (in terms of $Fe_2O_3$) (ppm) | Mill A | 10 | 20 | 40 |
| | Mill B | 10 | 20 | 0 |
| | Mill C | 10 | 0 | 0 |
| | Mill D | 10 | 0 | 0 |
| Duct | ECO outlet $O_2$ (duct A) | 3.5% | 3.2% | 3.0% |
| | ECO outlet $O_2$ (duct B) | 3.6% | 4.3% | 4.5% |

As described above, according to the present invention the selective reaction of an iron compound and an additive with a reducing substance controls the production of reactive mists of $Na_2O$ and $K_2O$ and of alkali metal silicates, such as low-melting $Na_2SiO_3$, $K_2SiO_3$, etc., and at the same time controls the conversion of $FeS_2$ present in coal to low-melting $FeSiO_3$, while promoting the conversions of $FeS_2$ to high-melting, adhesion-free $Fe_3O_4$ in a reducing atmosphere, which is changed into $Fe_2O_3$ in an oxidizing atmosphere. Furthermore, because of the very small size of the iron compound which is in the form of an aqueous solution or fine particles (100 mesh pass) and the extremely small amount used (2 to 200 ppm), the iron compound does not cause any increase in exhaust gas temperature nor in the amount of $NO_x$. This results in a markedly reduced level of cost and labor, as well as a reduced level of danger in the work of removing ash which has adhered to surfaces in the boiler, which would also involve stopping operations. Also, some types of coal which normally provide for only limited loads may be utilized to provide for higher loads if the addition of the iron compound in accordance with the present invention is carried out at a suitable point using an appropriate method. This offers a great merit. Since it is not necessary to blend coal with a low-slugging type of coal, costs and labor requirements are considerably reduced. The fact that operations can be adequately conducted even in a reducing atmosphere eliminates the need for blowing excessive air into a boiler, and the loss of exhaust gas is thus reduced, resulting in improved boiler efficiency.

Furthermore, the avoidance of water pipe damage due to clogging at the bottom of a boiler or the dropping of a large amount of clinker results in a greatly reduced cost.

A low level of accumulation of clinker on the furnace wall around a burner also solves the problem of the need to block off a burner tip.

What is claimed is:

1. A method of controlling the generation of clinker ash from exhaust gas dust comprising controlling the formation of clinker ash in a boiler or furnace which employs dust coal as a fuel by adding to a fuel at least one water soluble iron compound in an amount of 2 to 200 ppm in terms of $Fe_2O_3$ on the basis of the amount of dust coal, said iron compound(s) being in the form of an aqueous solution.

2. A method of controlling the generation of clinker ash from exhaust gas dust comprising controlling the formation of clinker ash in a boiler or furnace which employs dust coal as a fuel by adding to a fuel at a mill installed in a fuel line at least one water soluble iron compound in an amount of 2 to 200 ppm in terms of $Fe_2O_3$ on the basis of the amount of dust coal, said iron compound(s) being in the form of an aqueous solution.

3. A method according to claim 1 which comprises also adding to the fuel in conjunction with the water soluble iron compound(s) a water soluble compound selected from the group consisting of at least water soluble Cu, Mn, Co, Ni and Cr compound(s) in an effective amount to control the generation of clinker ash up to 50 ppm on the basis of the amount of coal dust in the fuel, said water soluble iron compound(s) and water soluble Cu, Mn, Co, Ni or Cr compound(s) being added to the fuel as an aqueous solution mixture.

4. A method according to claim 1 which comprises also adding to the fuel in conjunction with the water soluble iron compound, a water soluble compound selected from the group consisting of water soluble compounds of alkali metal and alkaline earth metals in an effective amount to control the generation of clinker ash up to 50 ppm on the basis of the amount of coal dust in the fuel, said water soluble iron compound(s) and water soluble alkali metal or alkaline earth metal compound(s) being added to the fuel in the form of an aqueous solution mixture.

5. A method according to claim 3 which comprises also adding to the fuel at least one water soluble alkali metal or alkaline earth metal compound(s) in an effective amount to control the generation of clinker ash up to 50 ppm, based upon the amount of coal dust in the fuel, said water soluble compounds all being added to the fuel as a mixture in an aqueous solution.

6. A method according to claim 2 which comprises also adding to the fuel in conjunction with the water soluble iron compound(s) a water soluble compound selected from the group consisting of at least water soluble Cu, Mn, Co, Ni or Cr compound(s) in an effective amount to control the generation of clinker ash up to 50 ppm on the basis of the amount of coal dust in the fuel, said water soluble iron compound(s) and water soluble Cu, Mn, Co, Ni or Cr compound(s) being added to the fuel as an aqueous solution mixture.

7. A method according to claim 2 which comprises also adding to the fuel in conjunction with the water soluble iron compound, a water soluble compound selected from the group consisting of water soluble compounds of alkali metal and alkaline earth metals in an effective amount to control the generation of clinker ash up to 50 ppm on the basis of the amount of coal dust in the fuel, said water soluble iron compound(s) and water soluble alkali metal or alkaline earth metal compound(s) being added to the fuel in the form of an aqueous solution mixture.

8. A method according to claim 6 which comprises also adding to the fuel at least one water soluble alkali metal or alkaline earth metal compound(s) in an effective amount to control the generation of clinker ash up to 50 ppm, based upon the amount of coal dust in the fuel, said water soluble compounds all being added to the fuel as a mixture in an aqueous solution.

* * * * *